US008210654B2

(12) United States Patent
Wei et al.

(10) Patent No.: US 8,210,654 B2
(45) Date of Patent: Jul. 3, 2012

(54) FLUID EJECTION DEVICE WITH ELECTRODES TO GENERATE ELECTRIC FIELD WITHIN CHAMBER

(75) Inventors: Qingqiao Wei, Corvallis, OR (US); Michael W. Cumbie, Albany, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 217 days.

(21) Appl. No.: 12/789,612

(22) Filed: May 28, 2010

(65) Prior Publication Data

US 2011/0292131 A1 Dec. 1, 2011

(51) Int. Cl.
*B41J 2/06* (2006.01)

(52) U.S. Cl. ..... 347/55; 347/56; 347/63; 347/65

(58) Field of Classification Search ..... 347/20, 347/54, 55, 56–59, 61–65, 67
See application file for complete search history.

(56) References Cited

U.S. PATENT DOCUMENTS

| | | | | |
|---|---|---|---|---|
| 4,769,658 | A * | 9/1988 | Oda et al. | 347/21 |
| 4,799,068 | A * | 1/1989 | Saito et al. | 347/55 |
| 4,881,089 | A * | 11/1989 | Saito et al. | 347/55 |
| 5,815,178 | A | 9/1998 | Silverbrook | |
| 6,315,914 | B1 | 11/2001 | Silverbrook | |
| 6,644,798 | B2 | 11/2003 | Katsuragi et al. | |
| 7,393,083 | B2 | 7/2008 | Silverbrook | |
| 2005/0238989 | A1 | 10/2005 | Kakui et al. | |
| 2007/0146428 | A1 | 6/2007 | Sakai et al. | |
| 2009/0027448 | A1 | 1/2009 | Silverbrook | |

* cited by examiner

*Primary Examiner* — Juanita D Jackson
(74) *Attorney, Agent, or Firm* — Nathan R. Rieth

(57) ABSTRACT

A fluid ejection device includes a chamber, and first and second electrodes configured to generate an electric field within the chamber. A related method includes, in a firing chamber, separating whole ink into colloidal particles and ink vehicle such that the firing fluid within the chamber comprises primarily ink vehicle.

12 Claims, 5 Drawing Sheets

FLUID EJECTION DEVICE WITH ELECTRODES TO GENERATE ELECTRIC FIELD WITHIN CHAMBER

BACKGROUND

In conventional drop-on-demand inkjet printing systems, inkjet printheads eject fluid droplets (e.g., ink) through a plurality of nozzles toward a print medium, such as a sheet of paper, to print an image onto the print medium. The nozzles are generally arranged in one or more arrays, such that properly sequenced ejection of ink from the nozzles causes characters or other images to be printed on the print medium as the printhead and the print medium move relative to one other.

In thermal bubble-type inkjet printing systems, a resistor heating element actuator in an ink-filled chamber vaporizes ink, creating a rapidly expanding bubble that forces an ink droplet out of a nozzle. Electrical current passing through the heating element generates the heat, vaporizing a small portion of the fluid within the chamber. As the heating element cools the vapor bubble collapses, drawing more fluid from a reservoir into the chamber in preparation for ejecting another drop through the nozzle.

Unfortunately, while the hot firing surface of the heating element drives droplet generation, it can also cause related problems in the thermal inkjet (TIJ) printing system. One such problem is the phenomenon known as 'kogation', which is the buildup of residue (koga) on the firing surface of the heating element. The repeated heating of the element and ink can cause a breakdown of pigments and other ink components, resulting in the fouling of the heating element surface. The buildup of koga on the firing surface of the heating element acts as an insulating barrier which reduces the efficiency of the vaporization process at the firing surface. The result is a reduction in volume and velocity of the ink droplet ejected from the printhead nozzle, and a corresponding decrease in print quality that can be seen on the print medium.

BRIEF DESCRIPTION OF THE DRAWINGS

The present embodiments will now be described, by way of example, with reference to the accompanying drawings, in which.

DETAILED DESCRIPTION

Overview of Problem and Solution

Figure 1:
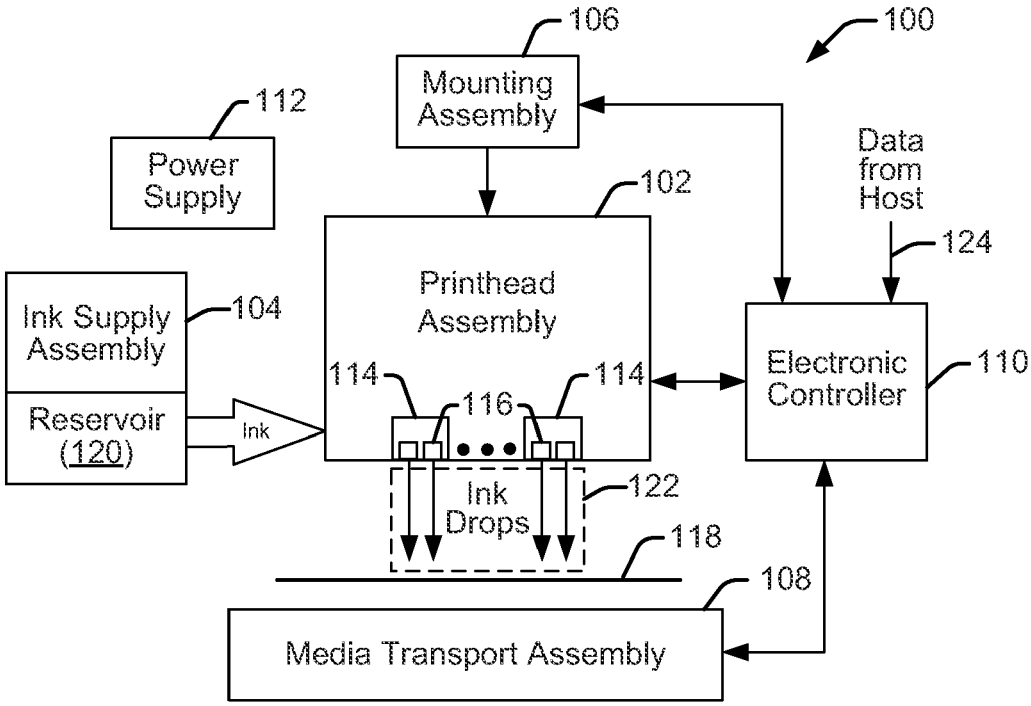
FIG. 1 illustrates an inkjet printing system suitable for incorporating a fluid ejection device, according to an embodiment.

As noted above, thermal inkjet (TIJ) printheads frequently suffer the effects of kogation, which is the buildup of residue (koga) on the firing surface of the heating element. Kogation contributes to a reduction in the velocity and volume of ejected ink droplets from the printhead, and can result in an overall decrease in print quality of the TIJ printing system.

Prior solutions to the problem of kogation have primarily involved adjusting the ink formulation to determine chemical combinations that are less reactive over the life of the printhead. Thus, for example, rather than optimizing ink for print quality or the market, ink development efforts for thermal inkjet printing systems have also included optimizing ink to achieve a reduced reactivity with the hot firing surface of the heating element in order to reduce kogation. However, such solutions to the kogation problem give rise to considerable disadvantages associated with thermal inkjet printing systems. For example, adjusting the ink formulation to reduce kogation places boundary conditions on the ink, narrowing the available ink space for thermal inkjet printheads. The narrowed availability of inks for use in thermal inkjet printheads constrains the printing markets available to thermal inkjet systems. Thus, the optimization of ink to reduce kogation compromises the customer experience with thermal inkjet printing systems.

Embodiments of the present disclosure overcome disadvantages associated with traditional methods of addressing the kogation problem, generally through an inkjet printhead that applies an electric field to reduce kogation at the firing surface of the heating element. The application of an electric field alters the composition of the ink in the vicinity of the firing surface so that the firing fluid portion of the ink that is vaporized by the firing surface consists primarily of the ink vehicle (e.g., water and solvent), rather than ink colloidal particles (e.g., dyes, pigments and polymers). The applied electric field pushes the colloidal particles most prone to forming koga away from the hot firing surface, thus preventing or reducing kogation at the firing surface.

In one embodiment, for example, a fluid ejection device includes a chamber, and first and second electrodes configured to generate an electric field within the chamber. In one implementation, the first electrode is the firing surface of the heating element in the chamber, and the first and second electrodes are configured to generate the electric field perpendicular to the firing surface. In another embodiment, a method to reduce kogation in a fluid ejection device includes, separating whole ink in the vicinity of the firing surface into ink colloidal particles and ink vehicle such that the firing fluid comprises primarily ink vehicle. In one implementation, separating the whole ink includes applying an electric field in the chamber in a direction perpendicular to a firing surface. In yet another embodiment, an inkjet printing system includes a fluid ejection device having a chamber and a heating element, and first and second electrodes disposed within the chamber. The heating element comprises the first electrode and the electrodes are configured to generate an electric field perpendicular to a firing surface of the heating element.

Illustrative Embodiments

FIG. 1 illustrates an inkjet printing system 100 suitable for incorporating a fluid ejection device as disclosed herein, according to an embodiment. In this embodiment, the fluid ejection device is disclosed as a fluid drop jetting printhead 114. Inkjet printing system 100 includes an inkjet printhead assembly 102, an ink supply assembly 104, a mounting assembly 106, a media transport assembly 108, an electronic controller 110, and at least one power supply 112 that provides power to the various electrical components of inkjet printing system 100. Inkjet printhead assembly 102 includes at least one printhead (fluid ejection device) or printhead die 114 that ejects drops of ink through a plurality of orifices or nozzles 116 toward a print medium 118 so as to print onto print medium 118. Print medium 118 is any type of suitable sheet material, such as paper, card stock, transparencies, Mylar, and the like. Typically, nozzles 116 are arranged in one or more columns or arrays such that properly sequenced ejection of ink from nozzles 116 causes characters, symbols, and/or other graphics or images to be printed upon print medium 118 as inkjet printhead assembly 102 and print medium 118 are moved relative to each other.

Ink supply assembly 104 supplies fluid ink to printhead assembly 102 and includes a reservoir 120 for storing ink. Ink flows from reservoir 120 to inkjet printhead assembly 102. Ink supply assembly 104 and inkjet printhead assembly 102 can form either a one-way ink delivery system or a recirculating ink delivery system. In a one-way ink delivery system, substantially all of the ink supplied to inkjet printhead assembly 102 is consumed during printing. In a recirculating ink delivery system, however, only a portion of the ink supplied to printhead assembly 102 is consumed during printing. Ink not consumed during printing is returned to ink supply assembly 104.

In one embodiment, inkjet printhead assembly 102 and ink supply assembly 104 are housed together in an inkjet cartridge or pen. In another embodiment, ink supply assembly 104 is separate from inkjet printhead assembly 102 and supplies ink to inkjet printhead assembly 102 through an interface connection, such as a supply tube. In either embodiment, reservoir 120 of ink supply assembly 104 may be removed, replaced, and/or refilled. In one embodiment, where inkjet printhead assembly 102 and ink supply assembly 104 are housed together in an inkjet cartridge, reservoir 120 includes a local reservoir located within the cartridge as well as a larger reservoir located separately from the cartridge. The separate, larger reservoir serves to refill the local reservoir. Accordingly, the separate, larger reservoir and/or the local reservoir may be removed, replaced, and/or refilled.

Mounting assembly 106 positions inkjet printhead assembly 102 relative to media transport assembly 108, and media transport assembly 108 positions print medium 118 relative to inkjet printhead assembly 102. Thus, a print zone 122 is defined adjacent to nozzles 116 in an area between inkjet printhead assembly 102 and print medium 118. In one embodiment, inkjet printhead assembly 102 is a scanning type printhead assembly. As such, mounting assembly 106 includes a carriage for moving inkjet printhead assembly 102 relative to media transport assembly 108 to scan print medium 118. In another embodiment, inkjet printhead assembly 102 is a non-scanning type printhead assembly. As such, mounting assembly 106 fixes inkjet printhead assembly 102 at a prescribed position relative to media transport assembly 108. Thus, media transport assembly 108 positions print medium 118 relative to inkjet printhead assembly 102.

Electronic controller or printer controller 110 typically includes a processor, firmware, and other printer electronics for communicating, with and controlling inkjet printhead assembly 102, mounting assembly 106, and media transport assembly 108. Electronic controller 110 receives data 124 from a host system, such as a computer, and includes memory for temporarily storing data 124. Typically, data 124 is sent to inkjet printing system 100 along an electronic, infrared, optical, or other information transfer path. Data 124 represents, for example, a document and/or file to be printed. As such, data 124 forms a print job for inkjet printing system 100 and includes one or more print job commands and/or command parameters.

In one embodiment, electronic controller 110 controls inkjet printhead assembly 102 for ejection of ink drops from nozzles 116. Thus, electronic controller 110 defines a pattern of ejected ink drops which form characters, symbols, and/or other graphics or images on print medium 118. The pattern of ejected ink drops is determined by the print job commands and/or command parameters.

In one embodiment, inkjet printhead assembly 102 includes one printhead 114. In another embodiment, inkjet printhead assembly 102 is a wide-array or multi-head printhead assembly. In one wide-array embodiment, inkjet printhead assembly 102 includes a carrier which carries printhead dies 114, provides electrical communication between printhead dies 114 and electronic controller 110, and provides fluidic communication between printhead dies 114 and ink supply assembly 104.

In one embodiment, inkjet printing system 100 is a drop-on-demand thermal bubble inkjet printing system wherein the printhead 114 is a thermal inkjet (TIJ) printhead. The thermal inkjet printhead implements a thermal resistor ejection element in an ink chamber to vaporize ink and create bubbles that force ink or other fluid drops out of a nozzle 116.

Figure 2:
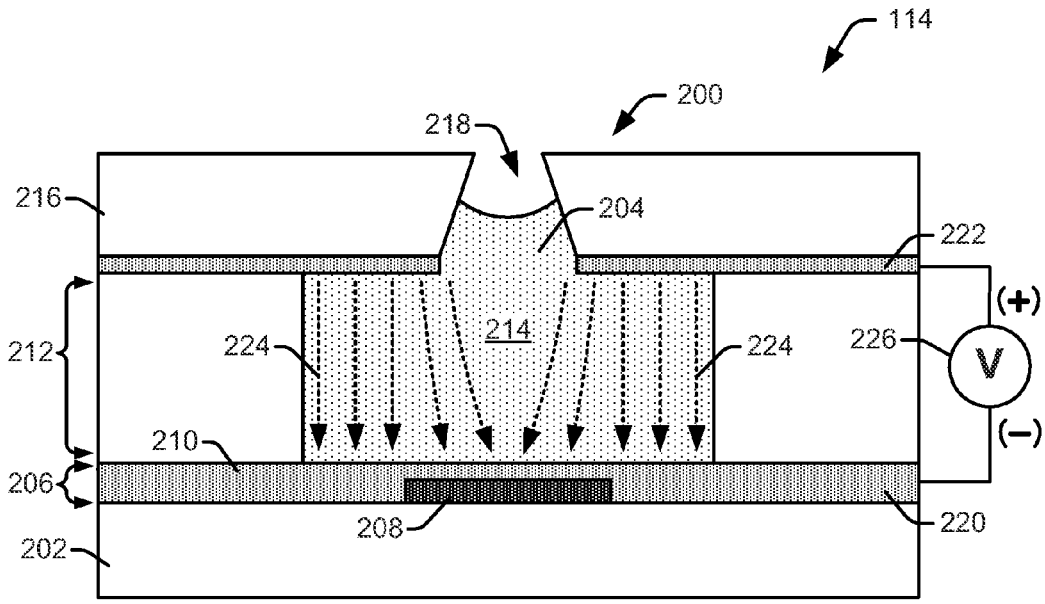
FIG. 2 illustrates a side view of a partial fluid ejection device implemented as thermal inkjet printhead, according to an embodiment.

FIG. 2 illustrates a side view of a partial fluid ejection device implemented as thermal inkjet printhead 114, according to an embodiment. The TIJ printhead 114 includes an array of fluid ejection elements 200. Ejection elements 200 are formed on a substrate 202 made, for example, of silicon, glass, ceramic, or a stable polymer. Substrate 202 has a fluid/ink feed slot 502 (FIG. 5) formed therein to supply fluid 204 (e.g., ink) to ejection elements 200. A thin-film structure 206 includes resistive heating element 208 and firing surface 210, formed for example, of tantalum, silicon dioxide, silicon carbide, silicon nitride, or other suitable material. A chamber or barrier layer 212 includes vaporization or firing chambers 214 formed therein. Chamber layer 212 can be formed, for example, of a photoimageable epoxy such as SU8. A nozzle layer 216 has a nozzle opening 218 formed therein. Nozzle layer 216 can be formed, for example, of a photoimageable epoxy such as SU8, a metal such as nickel, copper, iron-nickel alloy, palladium, gold, or rhodium, or of some other suitable material. In general, the components and structures of fluid ejection elements 200 can be fabricated using various precision microfabrication techniques such as electroforming, laser ablation, anisotropic etching, sputtering, dry etching, photolithography, casting, molding, stamping, and machining as are well-known to those skilled in the art. During printing, ink 204 flows through ink slot 502 (FIG. 5) to vaporization chamber 214. Nozzle opening 218 is operatively associated with heating element 208 such that droplets of ink within vaporization chamber 214 are ejected through nozzle opening 218 (e.g., substantially normal to the plane of heating element 208) and toward print medium 118 when heating element 208 is energized.

In one embodiment, fluid ejection elements 200 include first and second electrodes 220 and 222 configured to apply an electric field 224 through fluid 204 (e.g., ink) within the chamber 214. The first electrode 220 is implemented as the firing surface 210 (e.g., the tantalum cavitation layer) of the resistive heating element 208. The second electrode 222 is implemented in the illustrated embodiment (FIG. 2) in an out-of-plane orientation with respect to the first electrode 220. In other embodiments, as discussed below, the second electrode 222 is implemented in an in-plane orientation relative to the first electrode 220. In the case of the out-of-plane configuration, the second electrode 222 can be placed on the top or bottom surface of the nozzle layer 216. The out-of-plane second electrode 222 overlaps with the first electrode 220 (i.e., firing surface 210) to form a parallel plate capacitor, except for a gap area open to accommodate the nozzle opening 218. The second electrode 222 can be a metal thin film, such as tantalum, applied to the nozzle layer 216 surface, or it can be the nozzle layer 216 itself if the nozzle layer 216 is formed of an appropriately conductive material such as metal or conductive SU8. In some embodiments, either or both of the electrodes can be insulated from the fluid ink 204, for example, with a dielectric material such as silicon dioxide.

During operation, a voltage potential 226 applied across the first and second electrodes 220, 222, generates an electric field 224. Application of an electric field 224 in a direction perpendicular to the firing surface 210, such as across the firing chamber 214 from nozzle layer 216 to the firing surface 210, pushes charged ink particles away from the hot firing surface 210 by the force of electric field 224, as discussed in greater detail below.

Figure 3:
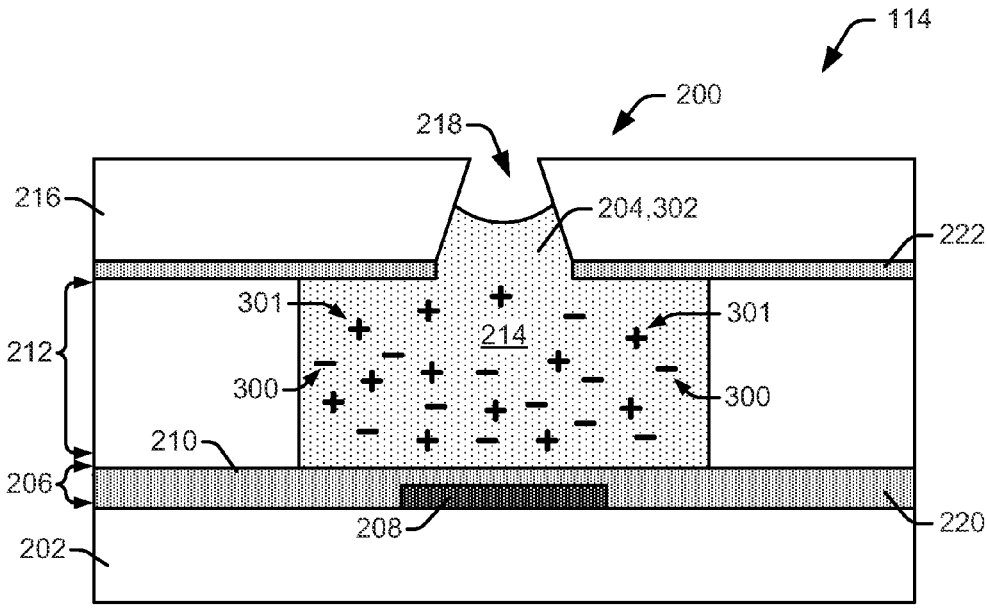
FIG. 3 illustrates another view of a fluid ejection element in a thermal inkjet printhead, according to an embodiment.

FIG. 3 illustrates another view of a fluid ejection element 200 in a thermal inkjet printhead 114, according to an embodiment. In FIG. 3, fluid ink 204 is represented in part as different ink components dispersed within whole ink without the application of an electric field 224. Generally, fluid ink 204 can be described as whole ink that includes suspended colloidal particles and an ink vehicle solution. The colloidal particles can include, for example, dyes, pigments and polymer micelles, while the ink vehicle can include solvents (e.g., hydrocarbons, alcohol) and water. In general, and as known to those skilled in the art, the colloidal ink particles have net surface electrical charges that are one of the primary reasons why the particles stay dispersed within the ink vehicle solution. The net surface charges can come from organic functional groups present on the surface of the particles and/or they can come from, or be enhanced by, additional surface chemistry on the particles. The net surface charges on the colloidal particles are balanced by free counter ions in the ink vehicle solution. The colloidal particles are charged with the same sign (i.e., polarity) so the electrostatic repulsion between them keeps them from coagulating and maintains their dispersion within the ink vehicle solution. The ink pH is typically above 9, so the colloidal particles are usually negatively charged.

As shown in FIG. 3, the "−" signs represent the colloidal ink particles 300 having net negative surface charges, and the "+" signs represent free counter ions 301 in ink vehicle solution (solvent, water) 302 having net positive charges. The colloidal ink particles 300 having the net negative surface charges are balanced by the positively charged free counter ions 301 in the ink vehicle solution 302, creating an electrostatic repulsion that keeps the particles 300 from coagulating and maintains their dispersion within the ink vehicle solution 302.

Figure 4:
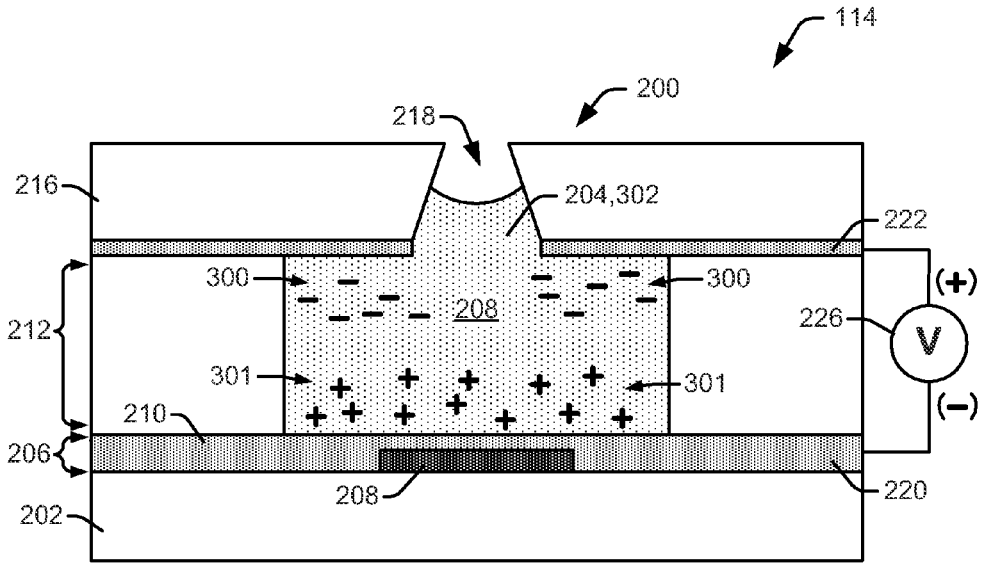
FIG. 4 illustrates the effect of an applied electric field on different components of whole ink within a fluid ejection element of a thermal inkjet printhead, according to an embodiment.

FIG. 4 illustrates the effect of an applied electric field on different components of whole ink within a fluid ejection element 200 of a thermal inkjet printhead 114, according to an embodiment. In FIG. 4, a voltage potential 226 is applied across the first and second electrodes 220, 222, generating an electric field 224 (FIG. 2). In some embodiments, the applied electric field may be varied, for example, to better accommodate varying compositions of ink within chamber 214. Accordingly, the frequency and magnitude of the applied voltage potential 226 can vary. The magnitude of the applied voltage 226 is typically on the order of 15 volts. The limit on the magnitude of the applied voltage potential 226 may be determined, in general by the voltage at which the ink composition within the chamber 214 begins to be affected, and/or the maximum voltage driving the printhead system. Thus, the maximum applied voltage potential 226 is typically on the order of 30 volts.

The electric field 224, oriented perpendicular to the firing surface 210, pushes the negatively charged colloidal ink particles 300 away from the negatively charged firing surface 210 while attracting the positively charged free counter ions 301, which are not known to cause kogation, toward the firing surface 210. Since the temperature away from the firing surface 210 (even a short distance away, such as 20-100 nm) is significantly lower than the temperature at the firing surface 210, the colloidal ink particles 300 no longer have the chance to experience high enough temperatures to form koga. In addition, any chemical reaction that might otherwise occur between the firing surface 210 and various colloidal particles 300 that could lead to kogation will be interrupted by such separation. While colloidal ink particles 300 are pushed away from the firing surface 210, the ink vehicle components 302 (solvent and water) including positively charged free counter ions 301, stay in contact with the firing surface 210 to allow drive bubble formation. Thus, the firing fluid (i.e., the portion of whole ink that is vaporized), is altered by application of the electric field 224 to be mostly free of colloidal ink particles and to contain mostly ink vehicle. In addition, the electric field 224 generally helps to maintain a layer of ink vehicle between the colloidal particles and the firing surface 210 and keeps the colloidal particles from settling down on the firing surface and forming permanent koga.

Figure 5:
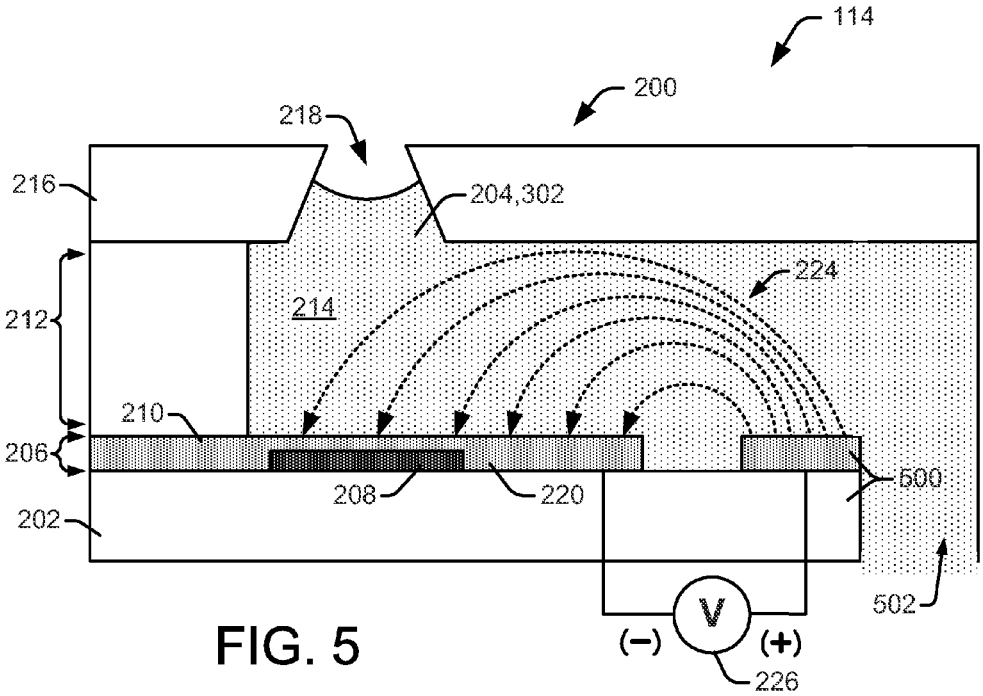
FIG. 5 illustrates a fluid ejection element of a thermal inkjet printhead having an in-plane electrode configuration, according to an embodiment.

FIG. 5 illustrates a fluid ejection element 200 of a thermal inkjet printhead 114 having an in-plane electrode configuration, according to an embodiment. As noted above, fluid ejection elements 200 include first and second electrodes configured to apply an electric field 224 through fluid 204 within chamber 214. As in the embodiments of FIGS. 2-4, the first electrode 220 in the embodiment of FIG. 5 is implemented as the firing surface 210 (e.g., the tantalum cavitation layer) of the resistive heating element 208. The second electrode 500, however, is implemented in an in-plane configuration such that the first and second electrodes 220, 500, are oriented in the same plane. In the case of the in-plane configuration, the second electrode 500 can be an added metal trace near the tantalum firing surface on the same substrate 202, or the exposed silicon substrate itself which forms a side of the ink slot 502. Although the electric field 224 in this embodiment is not perpendicular to the firing surface 210, the fringe field component of the electric field 224 between the pair of in-plane electrodes (i.e., 220, 500) acts to push the colloidal ink particles away from the firing surface 210 to reduce kogation.

Figure 6:
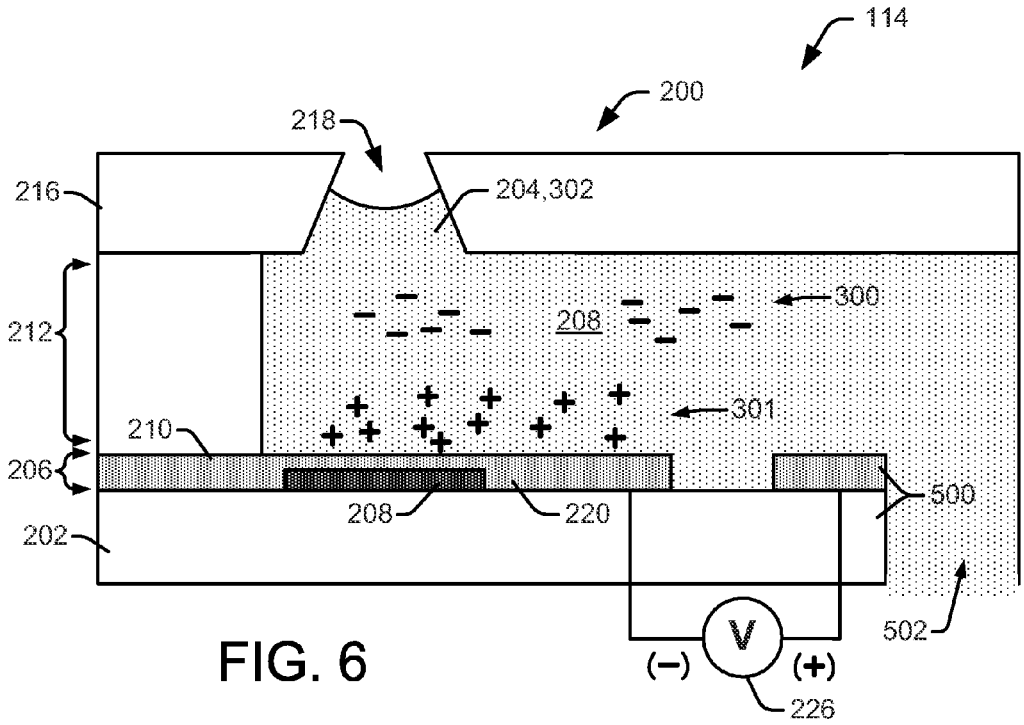
FIG. 6 illustrates the effect of an applied electric field from an in-plane, second electrode configuration on ink within a fluid ejection element of a thermal inkjet printhead, according to an embodiment.

FIG. 6 illustrates the effect of an applied electric field 224 from the in-plane, second electrode 500, configuration on different components of whole ink within a fluid ejection element 200 of a thermal inkjet printhead 114, according to an embodiment. As in FIG. 4 discussed above, a voltage potential 226 is applied across the first and second electrodes 220, 500, generating an electric field 224 (FIG. 5). The magnitude of the applied voltage potential 226 can vary as noted above and has the same general limits. The electric field 224, although not oriented completely perpendicular to the firing surface 210, includes fringe field components that push the negatively charged colloidal ink particles 300 away from the negatively charged firing surface 210 while attracting the positively charged free counter ions 301 toward the firing surface 210. Accordingly, kogation is reduced because the colloidal ink particles 300 have a significantly reduced chance of experiencing high enough temperatures to form koga, and any chemical reaction that might occur between the firing surface 210 and various colloidal particles 300 will be interrupted by the separation. While colloidal ink particles 300 are pushed away from the firing surface 210, the ink vehicle components 302 (solvent and water), including the positively charged free counter ions 301, stay in contact with the firing surface 210 to allow drive bubble formation. Thus, the firing fluid (i.e., the portion of whole ink that is vaporized), is altered by application of the electric field 224 to be mostly free of colloidal ink particles and to contain mostly ink vehicle. In addition, the electric field 224 generally helps to maintain a layer of ink vehicle between the colloidal particles and the firing surface 210 and keeps the colloidal particles from settling down on the firing surface and forming permanent koga.

Figure 7:
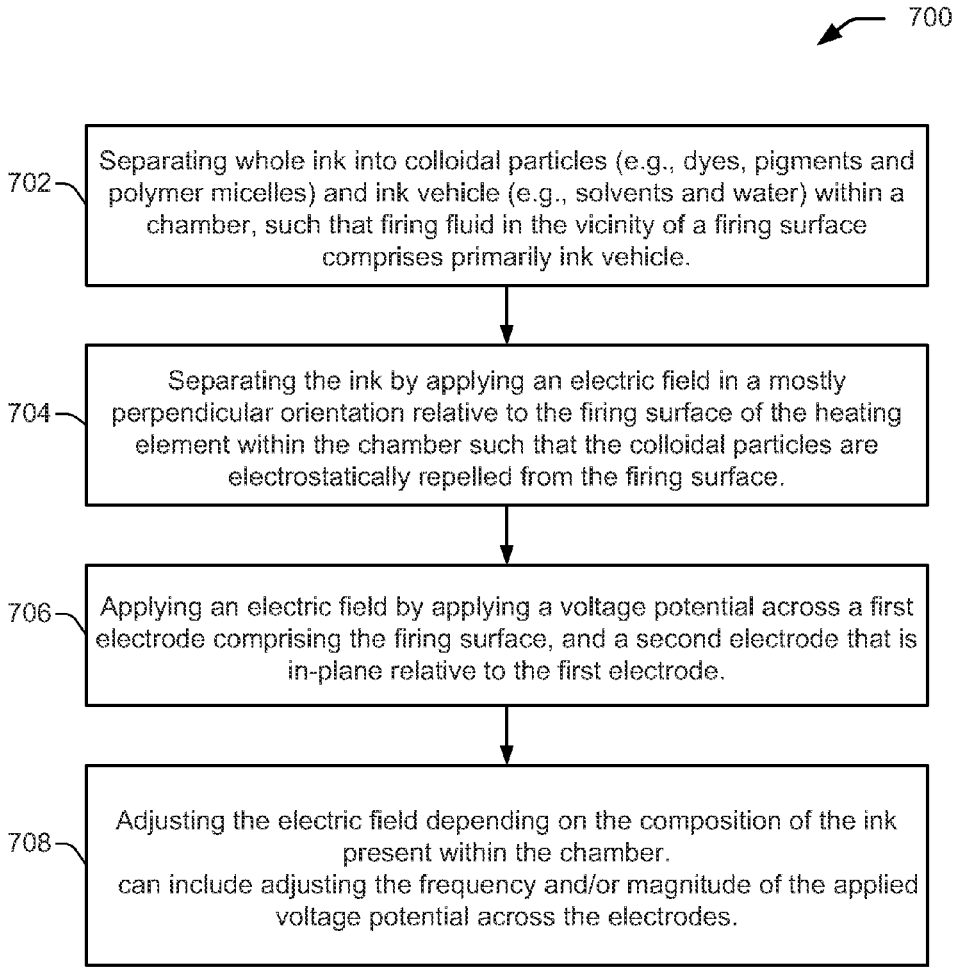
FIG. 7 shows a flowchart of an example method of reducing kogation in a fluid ejection device, according to an embodiment.

FIG. 7 shows a flowchart of an example method 700 of reducing kogation in a fluid ejection device, according to an embodiment. Method 700 is associated with the embodiments of a fluid ejection device 114 discussed above with respect to illustrations in FIGS. 1-6. Although method 700 includes steps listed in a certain order, it is to be understood that this does not limit the steps to being performed in this or any other particular order.

Method 700 begins at block 702 with separating whole ink into colloidal particles (e.g., dyes, pigments and polymer micelles) and ink vehicle solution (e.g., solvents and water) in the vicinity of the firing surface, such that firing fluid in the vicinity of the firing surface comprises primarily ink vehicle. The firing fluid is the component of whole ink that gets vaporized by the hot firing surface. As shown at block 704, separating ink colloidal particle from the ink vehicle includes applying an electric field in a mostly perpendicular orientation to the firing surface of the heating element within the chamber. The electric field is generated by the application of a voltage potential across first and second electrodes disposed within the chamber. The polarity of the applied voltage is chosen so that charged ink colloidal particles are electrostatically repelled from the firing surface.

At block 706, applying an electric field includes applying a voltage potential across a first electrode comprising the firing surface, and a second electrode that is in-plane relative to the first electrode. The method 700 continues at block 708 with adjusting the electric field depending on the composition of the ink present within the chamber. Adjusting the electric field can include adjusting the frequency and/or magnitude of the applied voltage potential across the electrodes.

What is claimed is:

1. A fluid ejection device comprising:

a chamber;

a first electrode comprising a firing surface formed on a silicon substrate; and a second electrode that is in-plane with the firing surface and that is an exposed portion of the silicon substrate which forms a side of an ink slot, or is a metal trace disposed near the firing surface on the silicon substrate;

wherein the first and second electrodes are configured to generate an electric field perpendicular to the firing surface within the chamber.

2. A fluid ejection device as in claim 1, wherein the second electrode is out-of-plane with the firing surface.

3. A fluid ejection device as in claim 1, further comprising a nozzle layer, wherein the second electrode is disposed between the chamber and the nozzle layer.

4. A fluid ejection device as in claim 3, wherein the first and second electrodes overlap one another to form a parallel plate capacitor.

5. A fluid ejection device as in claim 1, further comprising a conductive nozzle layer, wherein the second electrode comprises the conductive nozzle layer.

6. A fluid ejection device as in claim 1, wherein the electrodes comprise a layer of dielectric insulating material.

7. A method to reduce kogation in a fluid ejection device, comprising separating whole ink into colloidal particles and ink vehicle in the vicinity of a firing surface such that firing fluid comprises primarily ink vehicle.

8. A method as in claim 7, wherein the separating comprises applying an electric field in a chamber in a direction perpendicular to the firing surface such that the colloidal particles are electrostatically repelled from the firing surface.

9. A method as in claim 8, wherein applying an electric field comprises applying a voltage potential across a first electrode comprising the firing surface, and a second electrode that is in-plane with the first electrode.

10. A method as in claim 8, further comprising adjusting the electric field depending on the composition of the whole ink present within the chamber.

11. An inkjet printing system comprising:

a fluid ejection device having a chamber and a heating element; and first and second electrodes disposed within the chamber, wherein the heating element is formed on a silicon substrate and comprises the first electrode, and the second electrode is in-plane with the heating element and is an exposed portion of the silicon substrate which forms a side of an ink slot, or is a metal trace disposed near the heating element on the silicon substrate, and wherein the electrodes are configured to generate an electric field perpendicular to the heating element.

12. A printing system as in claim 11, further comprising a nozzle plate having a nozzle formed therein, wherein the nozzle plate comprises the second electrode.

* * * * *